US007357766B2

(12) United States Patent
Langer et al.

(10) Patent No.: US 7,357,766 B2
(45) Date of Patent: Apr. 15, 2008

(54) ADAPTABLE BODY CONDITIONING APPARATUS

(75) Inventors: Todd A. Langer, Lafayette, CO (US); Brent W. Murray, Longmont, CO (US); Clinton L. Percy, Erie, CO (US)

(73) Assignee: FunctionalInnovations, LLC, Lafayette, CO (US)

( * ) Notice: Subject to any disclaimer, the term of this patent is extended or adjusted under 35 U.S.C. 154(b) by 63 days.

(21) Appl. No.: 11/220,085

(22) Filed: Sep. 6, 2005

(65) Prior Publication Data

US 2007/0054791 A1 Mar. 8, 2007

(51) Int. Cl.
*A63B 22/14* (2006.01)
*A63B 22/16* (2006.01)

(52) U.S. Cl. ..... 482/146; 482/75

(58) Field of Classification Search ..... 482/146, 482/147, 34, 75, 76–77; D21/422; 623/28; 446/26–28, 70, 146, 276, 293–294; 36/15, 36/136, 100–112; 101/327, 333
See application file for complete search history.

(56) References Cited

U.S. PATENT DOCUMENTS 4,134,584 A 1/1979 Rosenbusch
4,610,448 A 9/1986 Hill
4,768,778 A 9/1988 Thomas, Jr.
5,358,463 A 10/1994 Fuentes
D374,045 S 9/1996 Ward, III
5,632,707 A 5/1997 Daniel et al.
5,713,823 A 2/1998 Walendzak et al.
6,413,197 B2 * 7/2002 McKechnie et al. ..... 482/146
6,716,145 B1 4/2004 Manailovich
D489,778 S 5/2004 Fan et al.
6,872,175 B2 * 3/2005 Lin ..... 482/146
7,008,359 B2 * 3/2006 Fan et al. ..... 482/146
2003/0032533 A1 * 2/2003 Hecox et al. ..... 482/127
2003/0181269 A1 * 9/2003 Griffin ..... 473/497
2004/0023766 A1 * 2/2004 Slone ..... 482/146

* cited by examiner

*Primary Examiner*—Lori Amerson
(74) *Attorney, Agent, or Firm*—Harold A. Burdick

(57) ABSTRACT

An adaptable body conditioning apparatus is disclosed having a relatively rigid platform and a resilient elevating and locating member receivable in an opening at an elevated center of the platform for adapting the platform for use in balance enhancing exercises. The locating member includes a releasable grip configured to hold the apparatus at the selected surface without surface modification. At least one resiliently stretchable cord attachment may be received through circumferential openings in the platform. A handle attachment having a stem may replace the locating member and is receivable through the opening at the elevated center of the platform.

18 Claims, 19 Drawing Sheets

ADAPTABLE BODY CONDITIONING APPARATUS

FIELD OF THE INVENTION

This invention relates to exercise apparatus, and, more particularly, relates to apparatus adaptable to vary exercise parameters and/or conduct different types of exercise.

BACKGROUND OF THE INVENTION

It is known that the impact of poor postural control influences both breathing and upright movement, and leads to long-standing ramifications in the template of muscle and connective tissue (myofascia) that supports our organs and skeletal frame. The cultural phenomenon of sitting in a car, or at a work desk, and performing repetitive tasks takes a further toll on the body as it adapts to the imposed demands. The body's response is to build stronger muscle and lay down connective tissue over the specific areas that are overworking, in what is essentially a futile attempt at stabilizing itself. This eventually leads to inefficient posture, and altered biomechanics, as range of motion becomes restricted and musculoskeletal compensations create an imbalance throughout the entire body.

Maintaining physical fitness and muscle tone is a challenge for many who find they have little time for gyms, fitness classes, running or biking regimens or the like. A convenient means to exercise during a busy day is required in many cases, often entailing forms of exercise that can be conducted in the home, office or hotel. Calisthenics may work for some, but without proper training may offer quite limited results and/or unbalanced or harmful results, and are uninteresting leading in time to loss of dedication. Various cardiovascular workout machines such as treadmills, stair climbers, stationary bicycles and the like, as well as weight training equipment and machines, are also in common use, but require a dedicated location, often a quite extensive area. Moreover, in use such machines and equipment tend to restrict natural patterns of body movement.

Many, if not most, exercise machines inhibit natural movement patterns and are only utilized within a context restricted to very specific situations. Some such machines are designed so that the initial stages of a movement start from an unsuitable biomechanical position and force the lumbar spine into a fully flexed position. Such positions actually increase the risk of low back injury. If an exercise machine requires a seated position, it prevents training the feet, ankles, knees, and hips to absorb the necessary loading and proprioceptive challenges encountered in active daily living, serving instead as the kind of tool used by body builders to increase the size of certain muscles without much crossover in functionality.

A huge variety of more compact physical training devices have been conceived of for both cardiovascular and muscle work out, but most target only a limited muscle group at best. Moreover, such devices often inadequately train the muscle group for which they are intended (for example, training a muscle without a full range of motion thus leading to unbalanced musculature and/or impeding proper joint movement). Some devices may actually cause more harm than good when used without adequate supervision, for example by positioning the user in a less than advantageous biomechanical position (often a precursor to injury). Often balance training and core strength and stability training are overlooked entirely, two quite important forms of training, particularly for workers, athletes, as well as for an aging population in general.

Balance boards, balls and similar such devices have been partially successful in addressing the need for balance and core training, and a variety have such devices are known (see, for example, U.S. Patent Application Publication Nos. 2004/0023766 and 2003/0032533, and U.S. Design Pat. No. D489,778). Likewise, devices utilized with upper body exercises such as push-ups, and having means to vary exercise parameters, have also been suggested and/or utilized (see U.S. Pat. Nos. 5,358,463, 4,134,584, 5,632,707, 4,768,778, 4,610,448, 5,713,823, 6,186,930, 6,716,145, 5,205,802, and Des. 374,405, for example).

Such heretofore suggested and/or utilized devices, however, are typically directed to only a single variety of exercise and provide only limited adaptability of workout parameters even within the exercise type to which they are directed. In addition such devices are often unduly complex, unwieldy, and/or bulky, and can be difficult to adjust, maneuver and/or use.

SUMMARY OF THE INVENTION

This invention provides a body conditioning apparatus that is adaptable for training multiple muscle groups while also addressing balance and core strength and stability. The apparatus is configured to accommodate muscle training across a variety of muscle motions, through the full range of such motions, and from a variety of exercise attack positions and angles. In this way proper muscle depelopment, joint movement and balance are better addressed in a safe and restorative manner.

The apparatus is reconfigurable (adaptable) to accommodate plural exercise types, providing extensive adaptability of workout parameters within each of the exercise types which can be accommodated. The apparatus is simple to use and adjust, is lightweight and easily maneuverable, is quite durable, and is usable in almost all locations without regard to the type of workout surface (carpeted or hard surfaces).

The apparatus of this invention includes a relatively rigid platform having a substantially flat side and an opposite side. A resilient locating member includes a mounting part centrally affixed at the opposite side of the platform, and a support spaced from the mounting part configured to stabilize the apparatus at a selected workout surface. The support is preferably a releasable grip configured to firmly but readily releasably hold the apparatus at the selected surface without surface alteration.

The platform is preferably disc shaped with the opposite side elevated toward its center and having an opening thereat. The locating member is preferably a one piece member and elevates the platform from the surface for use in balance enhancing exercises. The mounting part thereof is centrally, preferably releasably, affixable through the opening at the elevated center of the opposite side of the platform. A bendable neck is located between the mounting part and the support of the locating member. The apparatus of this invention may be used alone, in a pair or in other groupings (three, four or even more apparatus can be usefully applied for different exercise regimen).

At least one additional attachment is preferably receivable at the platform for a different type of exercise. For example, the platform of the apparatus may include circumferential openings having at least one resiliently stretchable cord selectively receivable therethrough. In addition, or alternatively, a plurality of gripping feet could be positioned in the circumferential openings for resisting sliding of the platform when the resilient elevating and locating member is released and the platform is turned over thus allowing use of the platform in an alternative exercise with the flat side adjacent the selected surface. For one such exercise, the apparatus includes a handle having a stem receivable in the opening at the elevated center of the platform when the resilient member is released from the platform. The handle may be used for a variety of exercises, for example push-ups when the apparatus thus configured is used in a pair.

It is therefore an object of this invention to provide an improved compact body conditioning apparatus.

It is another object of this invention to provide an adaptable body conditioning apparatus.

It is still another object of this invention to provide a body conditioning apparatus that is adaptable for training multiple muscle groups while also addressing balance, proper joint movement, and core strength and stability.

It is yet another object of this invention to provide a body conditioning apparatus that is configured to allow muscle training across a variety of muscle motions, through the full range of such motions, and from a variety of exercise attack positions and angles.

It is another object of this invention to provide a body conditioning apparatus that is reconfigurable to accommodate plural exercise types while providing extensive adaptability of workout parameters within each type.

It is still another object of this invention to provide an adaptable body conditioning apparatus that is simple to use and adjust, that is lightweight, maneuverable and durable, and that is capable of use without regard to the type of surface where a workout utilizing the apparatus is to be conducted.

It is yet another object of this invention to provide a surface locatable body conditioning apparatus that includes a relatively rigid platform having a substantially flat side and an opposite side, and a resilient locating member having one part centrally affixed at the opposite side of the platform and having a releasable grip spaced from the one part configured to firmly but readily releasably hold the apparatus at the selected surface without surface alteration.

It is another object of this invention to provide a body conditioning and balance training apparatus including a relatively rigid disc shaped platform having a substantially flat side and an opposite side that is elevated toward its center, the elevated center having an opening thereat, and a one piece resilient elevating and locating member having one part centrally affixable through the opening at the elevated center of the opposite side of the platform, a support spaced from the one part configured to stabilize the apparatus at a selected workout location, and a neck located between the one part and the support.

It is still another object of this invention to provide a surface locatable adaptable body conditioning apparatus that includes a relatively rigid platform having a substantially flat side and an opposite side that is elevated toward its center, a resilient elevating and locating member for adapting the platform for use in balance enhancing exercises and having one part releasably securable to the platform and having a releasable grip spaced from the one part configured to hold the apparatus at the selected surface, and at least one additional attachment receivable at the platform for a different type of exercise.

It is yet another object of this invention to provide a surface locatable adaptable body conditioning apparatus comprising a relatively rigid platform, a resilient elevating and locating member for adapting the platform for use in balance enhancing exercises, and at least one resiliently stretchable cord selectively receivable at and extending from the platform.

It is yet another object of this invention to provide a surface locatable adaptable body conditioning apparatus comprising a relatively rigid platform having a flat side, a resilient elevating and locating member for adapting the platform for use in balance enhancing exercises, a plurality of gripping feet positioned in the flat side of the platform for resisting sliding of the platform when the resilient member is released and the platform is turned over with the flat side adjacent the selected surface, and a handle having a stem receivable at the elevated center of the platform when the resilient member is released from the platform.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
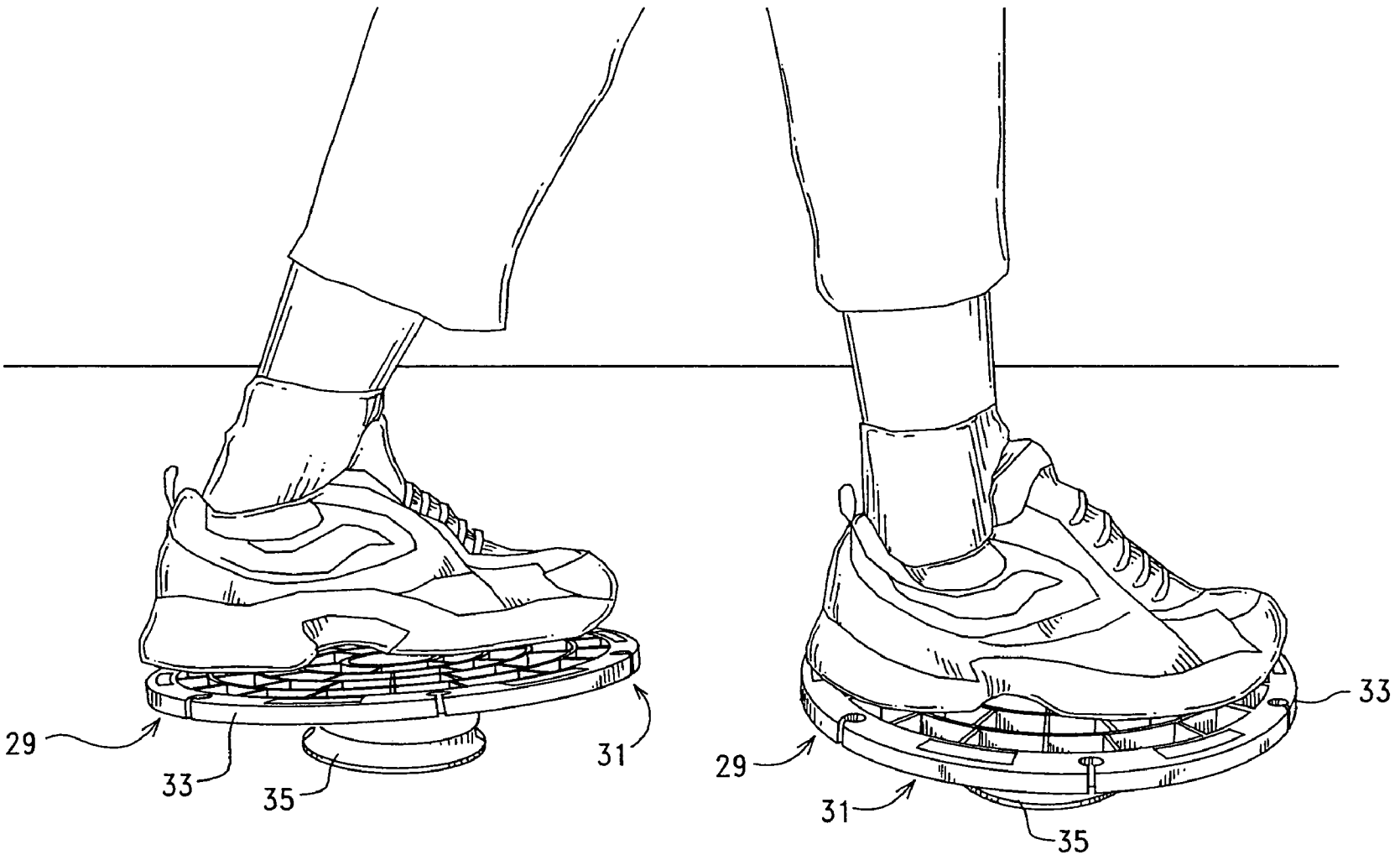
FIG. 1 is a perspective view of the adaptable body conditioning apparatus of this invention in a first configuration.
Figure 2:
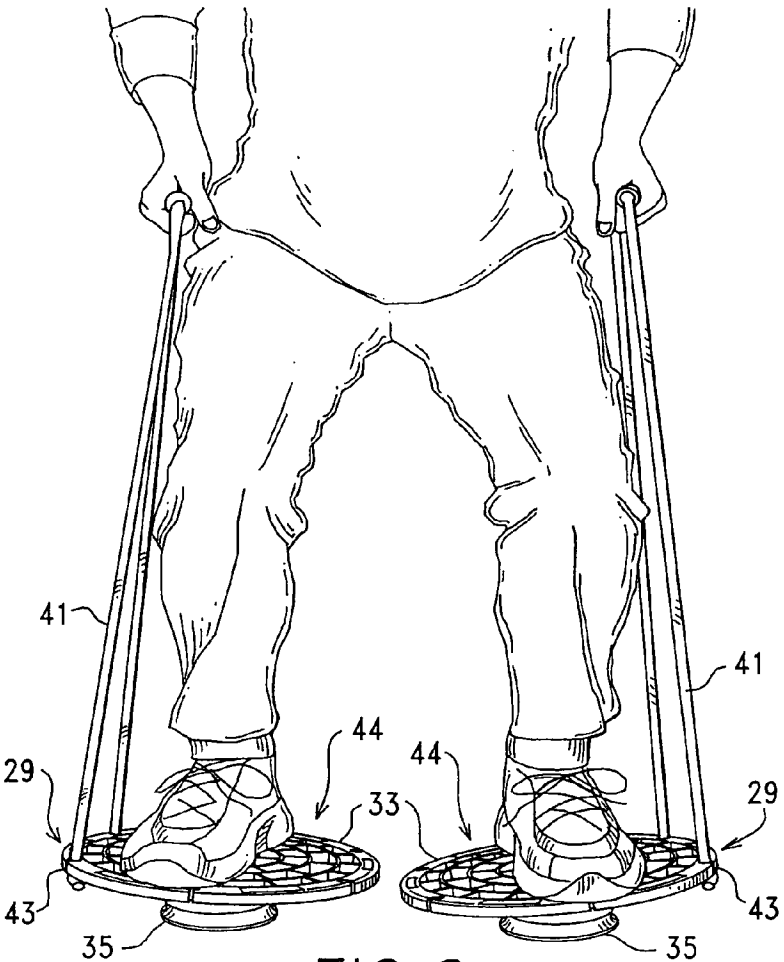
FIG. 2 is a perspective view of the adaptable body conditioning apparatus of this invention in a second configuration.
Figure 3:
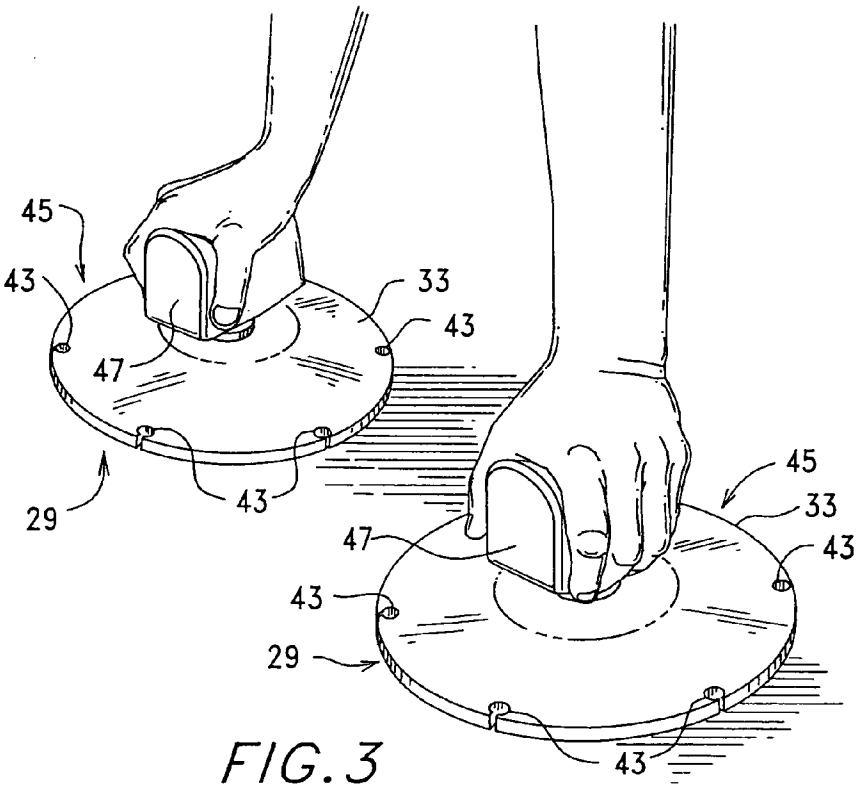
FIG. 3 is a perspective view of the adaptable body conditioning apparatus of this invention in a third configuration.

FIGS. 1 through 3 show apparatus 29 of this invention in three different configurations adapted for different exercises (in each case shown used in a pair, though only a single or more than two apparatus could be used). In FIG. 1, apparatus 29 is adapted for use in a balance platform configuration 31 for body strengthening and balance/core strength enhancing exercise, in this case for lower body (leg) exercise. The apparatus includes platform 33 and elevating and locating member 35. Platform 33 is preferably disc shaped with a diameter about the same as the length of a large size athletic shoe (various sizes and platform shapes could, however, be utilized in this invention), and can be made of any relatively rigid material such as plastic, metal or wood (preferably molded polypropylene plastic). Elevating and locating member 35 is preferably a one-piece member made of resilient material (for example, rubber material of a selected durometer sufficient to allow slow to rapid deformation under pressure exerted by the weight of a user while yet remaining durable).

In FIG. 2, apparatus 29 is readapted by an additional attachment, resilient cords 41 (preferably stretchable rubber material, two cords shown though a different number of cords could be employed). Cords 41 are positioned through circumferential openings 43 through platform 33, this adaptation providing a multi-workout configuration 44. The cords may be utilized to assist balance training or for upper body (arm) and lower body (leg) workouts, and may be used alone or in combination with a balance platform configuration 31 workout, for example. Cords 41 are preferably length adjustable.

Apparatus 29 is shown adapted for use in a push-up type exercise configuration 45 (when used in a pair) in FIG. 3. In this configuration, making use of another additional attachment, elevating and locating member 35 is removed (released from platform 33 as more fully disclosed hereinafter), and platform 33 is turned over to serve as a base. Handles 47 (made of any rigid material, preferably molded polypropylene) are centrally positioned in platform 33 and are sized and configured to be gripped by a user as shown. Handles 47 are adaptable and adjustable to allow user induced movement of the handles in a various ways as discussed hereinafter.

Figure 4:
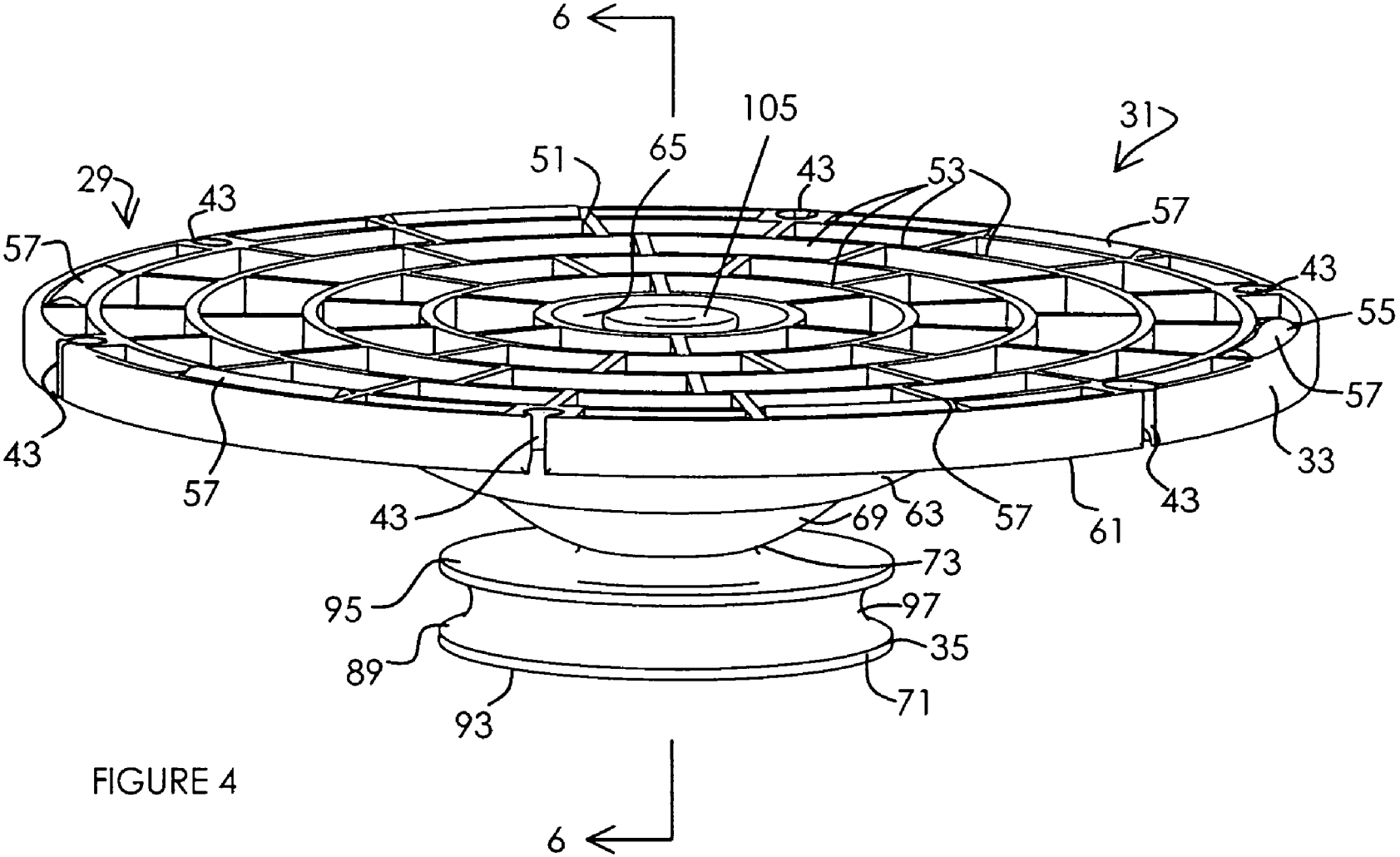
FIG. 4 is a perspective view of the apparatus of this invention as configured in FIG. 1.
Figure 5:
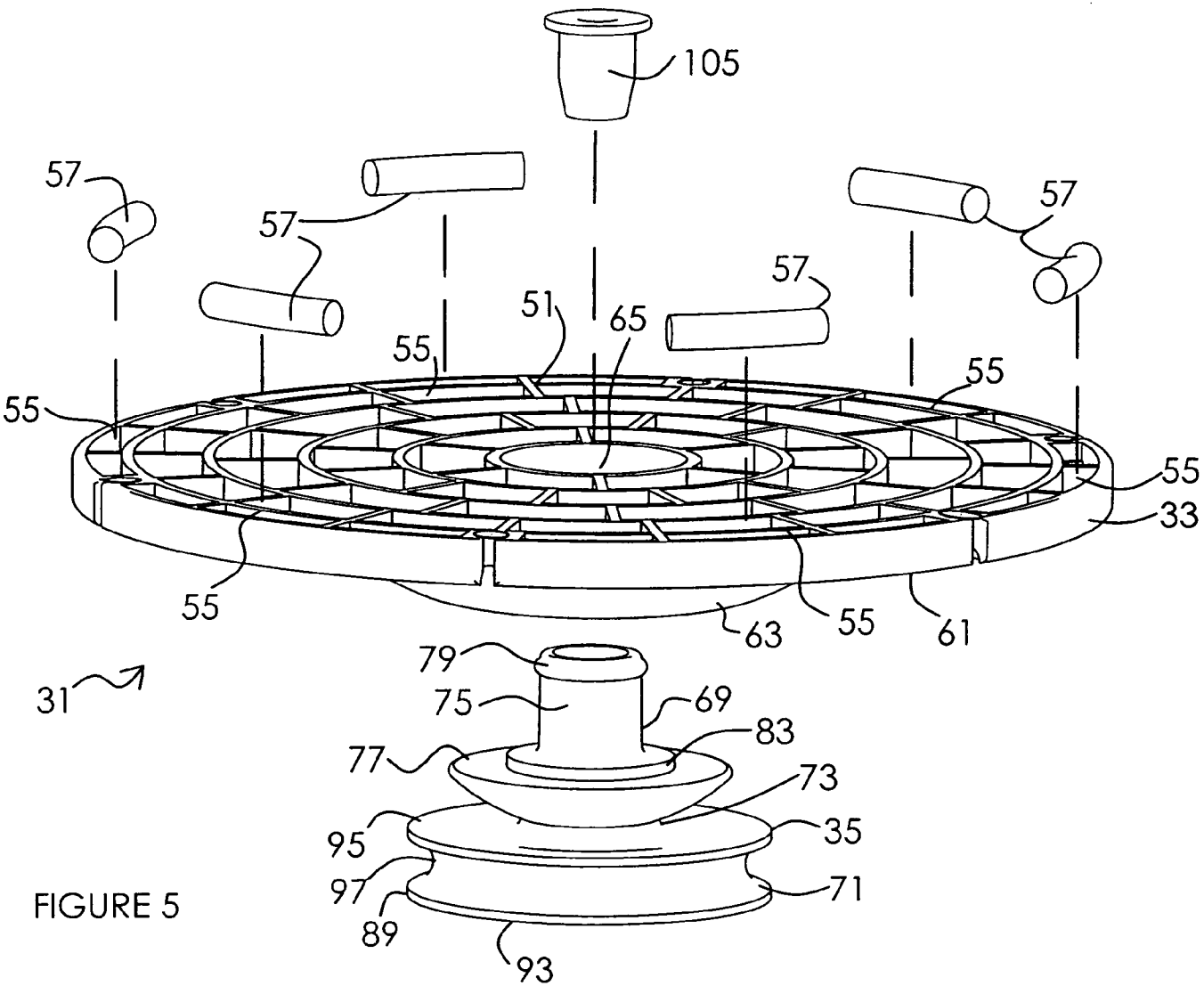
FIG. 5 is an exploded view of the apparatus as shown in FIG. 4.
Figure 6:
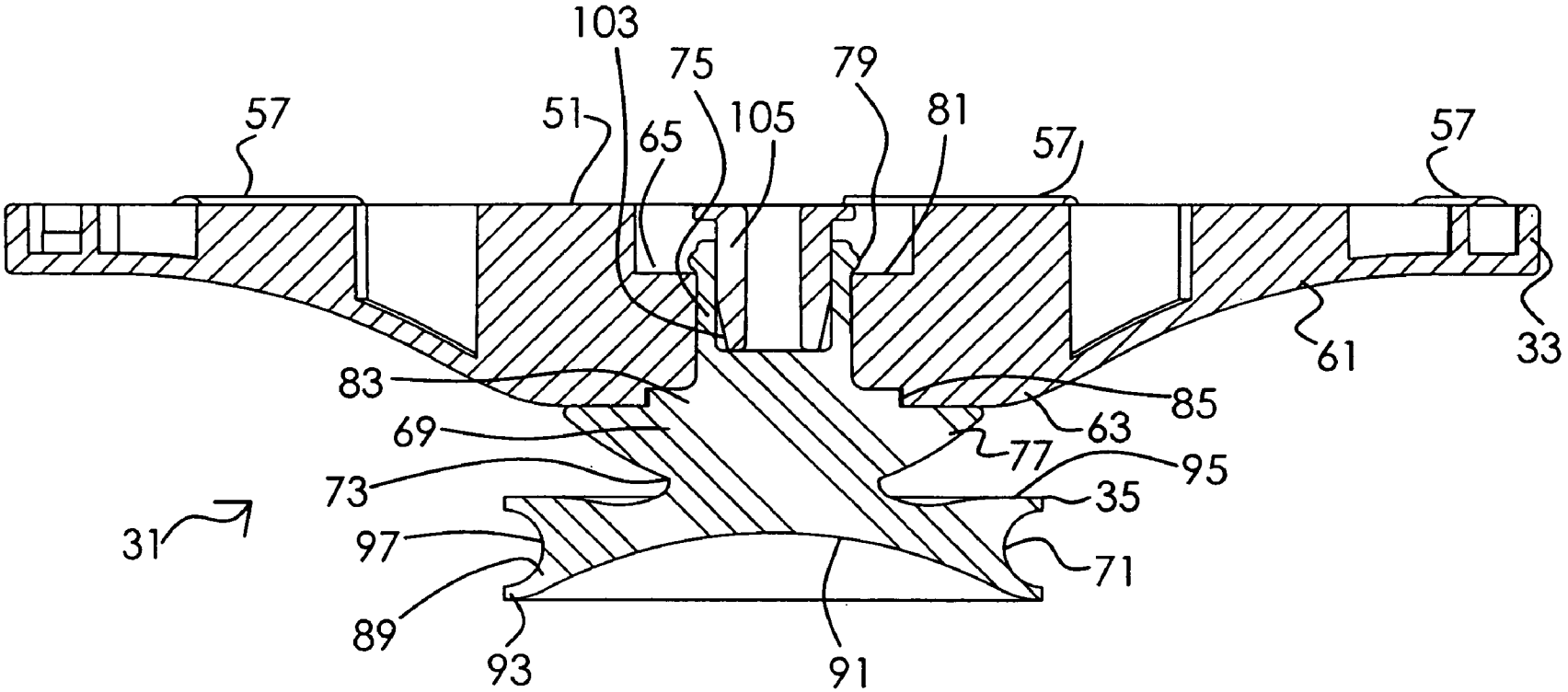
FIG. 6 is a sectional view taken through section lines 6-6 of FIG. 4.

Turning to FIGS. 4 through 6, balance platform configuration 31 of apparatus 29 is shown in greater detail. Platform 33 includes substantially flat surface side 51 having a plurality of voids 53 therein (primarily to strengthen platform 33 while saving on material costs, though some serve other purposes as described herein and all serve to provide some traction to a user in this configuration). Of these voids, the use of openings 43 has already been addressed. In addition, circumferential openings 55 are provided for receipt of gripping feet 57 therein (made of cut rubber cord, primarily for use with configuration 45 to prevent sliding of platform 33 when inverted as described hereinafter).

Side 61, opposite flat side 51, has an elevated, preferably a truncated dome shaped, center 63 with opening 65 therethrough extending to side 51. Elevating and locating member 35 includes one part 69 affixed at opening 65 and releasable support and grip 71 spaced from part 69. Flexible neck 73 is positioned between part 69 and grip 71 and has a cross sectional dimension (diameter as embodied in the drawings) smaller than either part 69 or grip 71. Grip 71 has a diameter substantially smaller than diameter of platform 33. Preferably, part 69 provides a flexible and readily releasable mounting arrangement including shaft extension 75 extending from half-oval hub 77 and having annular protuberance 79 at the uppermost part thereof. Shaft extension 75 extends through opening 65 through platform 33 and is of a length so that annular protuberance 79 is secured at annular shoulder 81 at the upper part of opening 65 when fully inserted (see FIG. 6) thereby releasably maintaining member 35 at platform 33. Annular ring 83 of member 35 is configured to snugly fit in annular void 85 at elevated center 63 of platform 33 to further center and strengthen the interconnection during use (see FIGS. 5 and 6).

Releasable grip 71 of elevating and locating member 35 is preferably configured as a suction grip having suction cup structure 89 including concave surface 91, outer sealing ring 93 and an upper body 95. Upper body 95 and cup structure 89 are separated at their outer edges by a concave annular area 97 thereby accommodating compression of the cup on a selected surface for firmly but readily releasably holding the apparatus at the selected surface without requirement of any surface alteration (by the suction created in cup structure 89). Other non-invasive grips could be conceived of.

Figure 7:
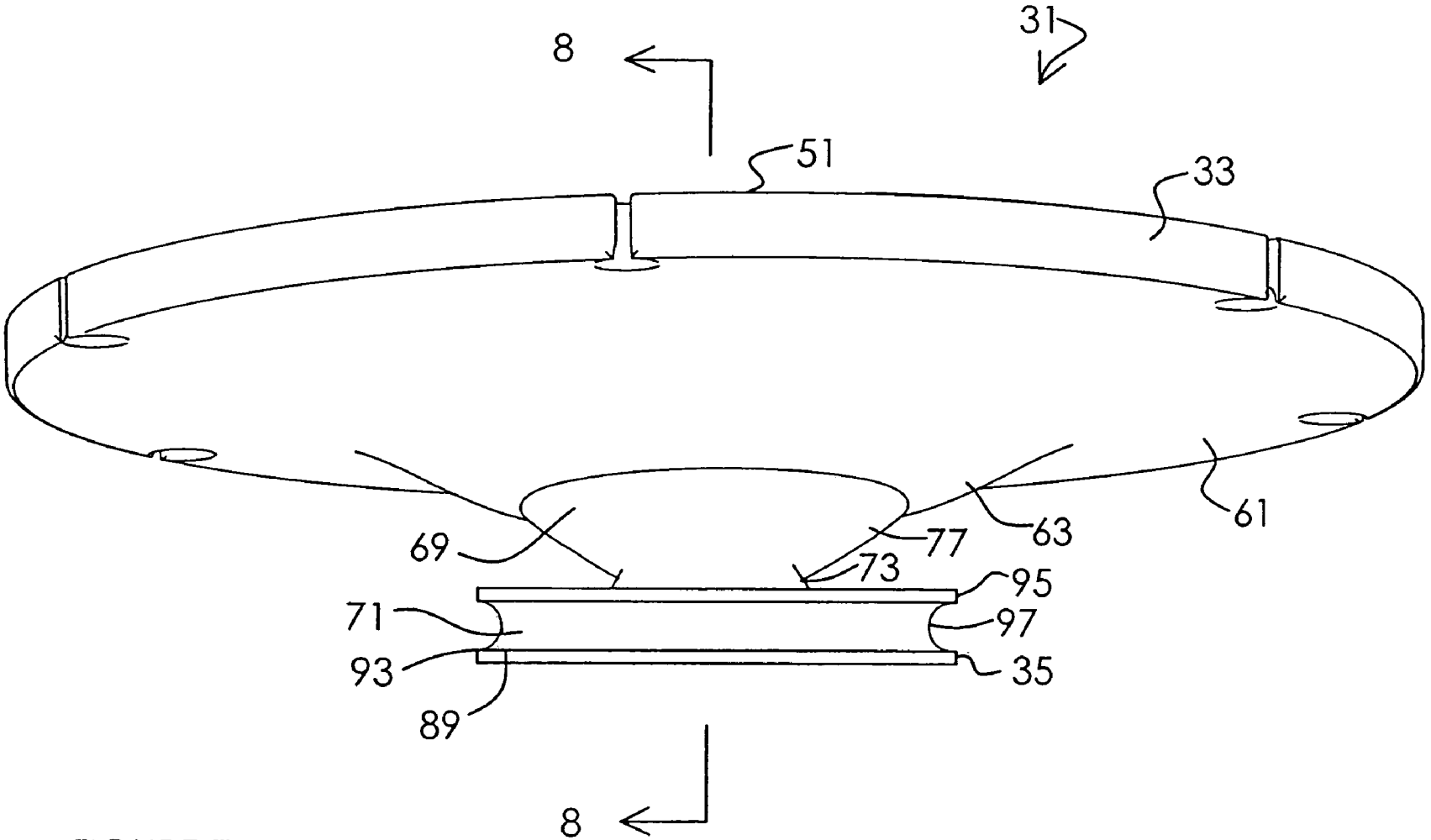
FIG. 7 is a side view showing the apparatus as shown in FIG. 4 with a force applied from above at the opposite side.
Figure 8:
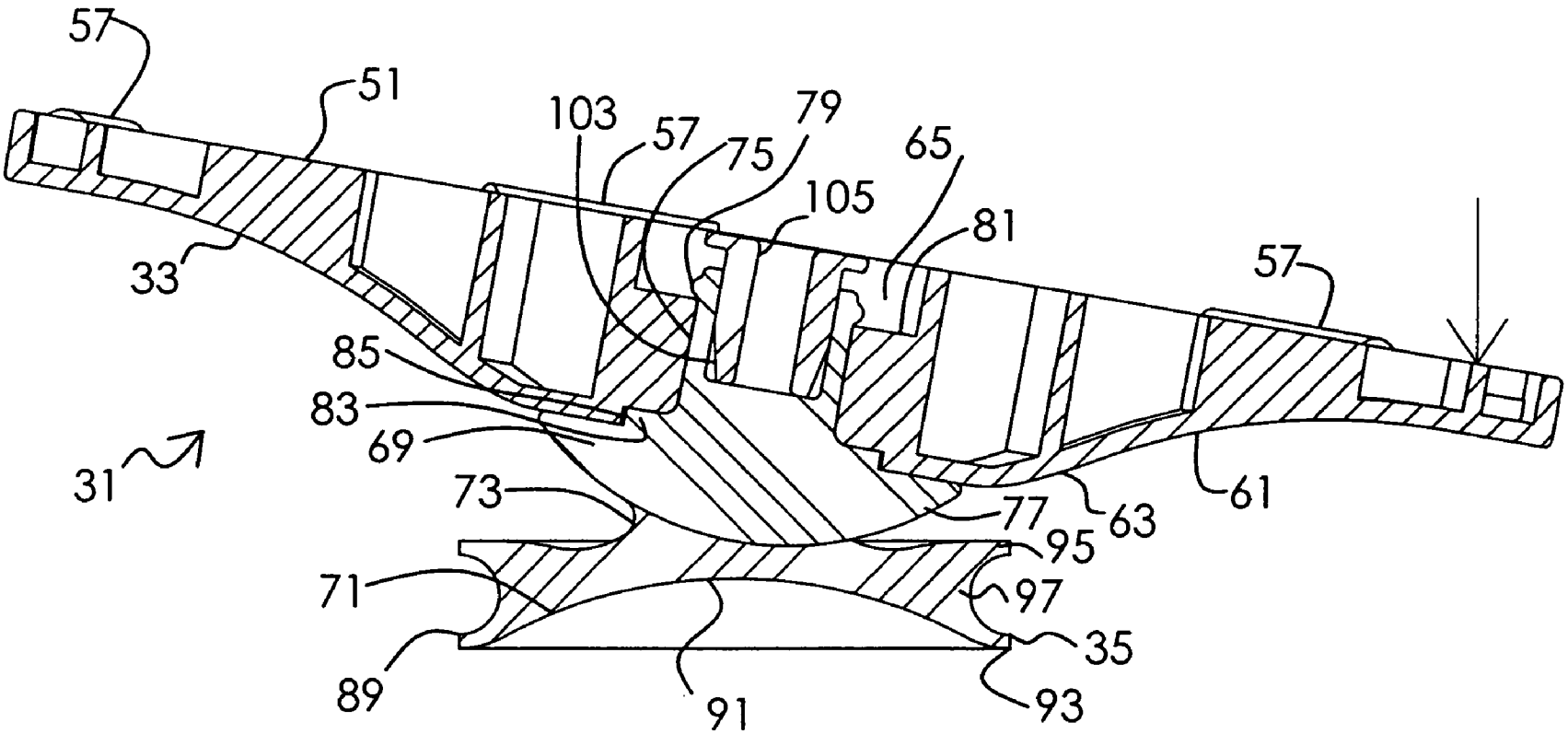
FIG. 8 is a sectional view taken through section lines 8-8 of FIG. 7.

Shaft extension 75 is preferably tubular having an upper annular cavity 103 thereat for receipt of plug/lock 105 (preferably a nylon plug) which, when inserted (as shown in FIG. 6) maintains the diameter of annular protuberance 79 thus assuring that extension 75 remains reliably seated. In use, as illustrated in FIGS. 7 and 8, as a user's weight shifts about on side 51 of platform 33 the platform is allowed to tilt accordingly (universally tiltable) by the compression and flexion of member 35, and particularly at neck 73, thus challenging the balance of the user and developing greater core stability.

Figure 9:
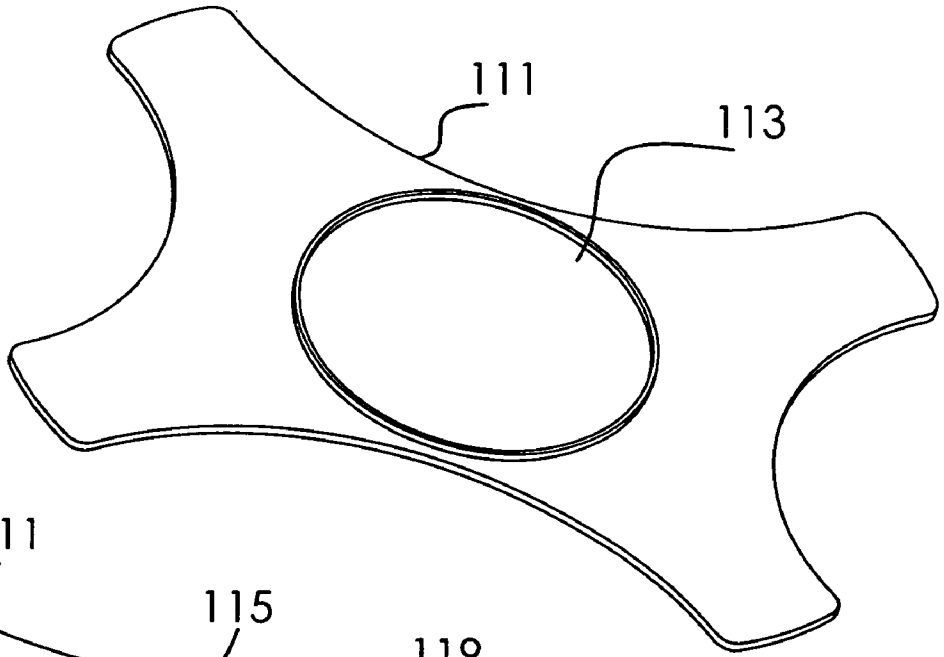
FIG. 9 is a perspective view of a retention mat for the apparatus of this invention as shown in FIG. 4 when deployed on carpeted surfaces.
Figure 10:
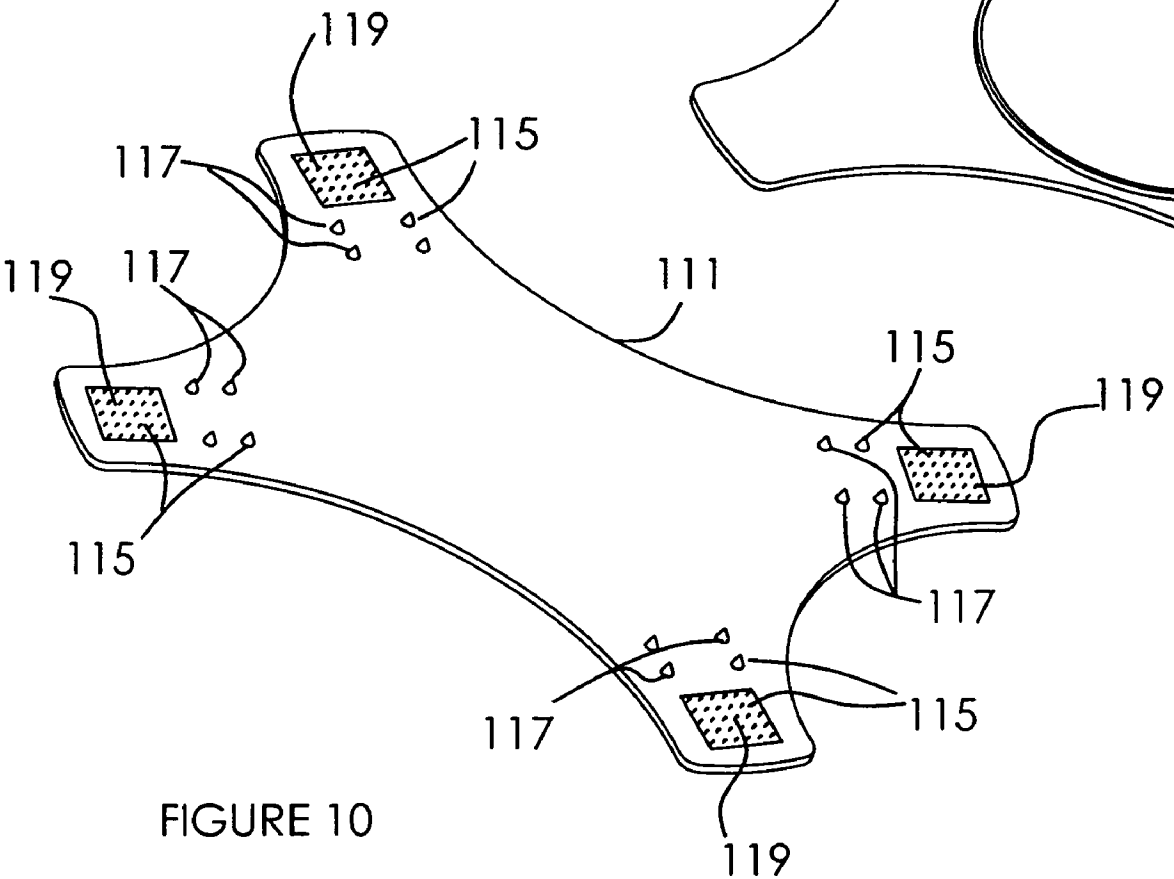
FIG. 10 is a reverse perspective view of the mat of FIG. 9.
Figure 11:
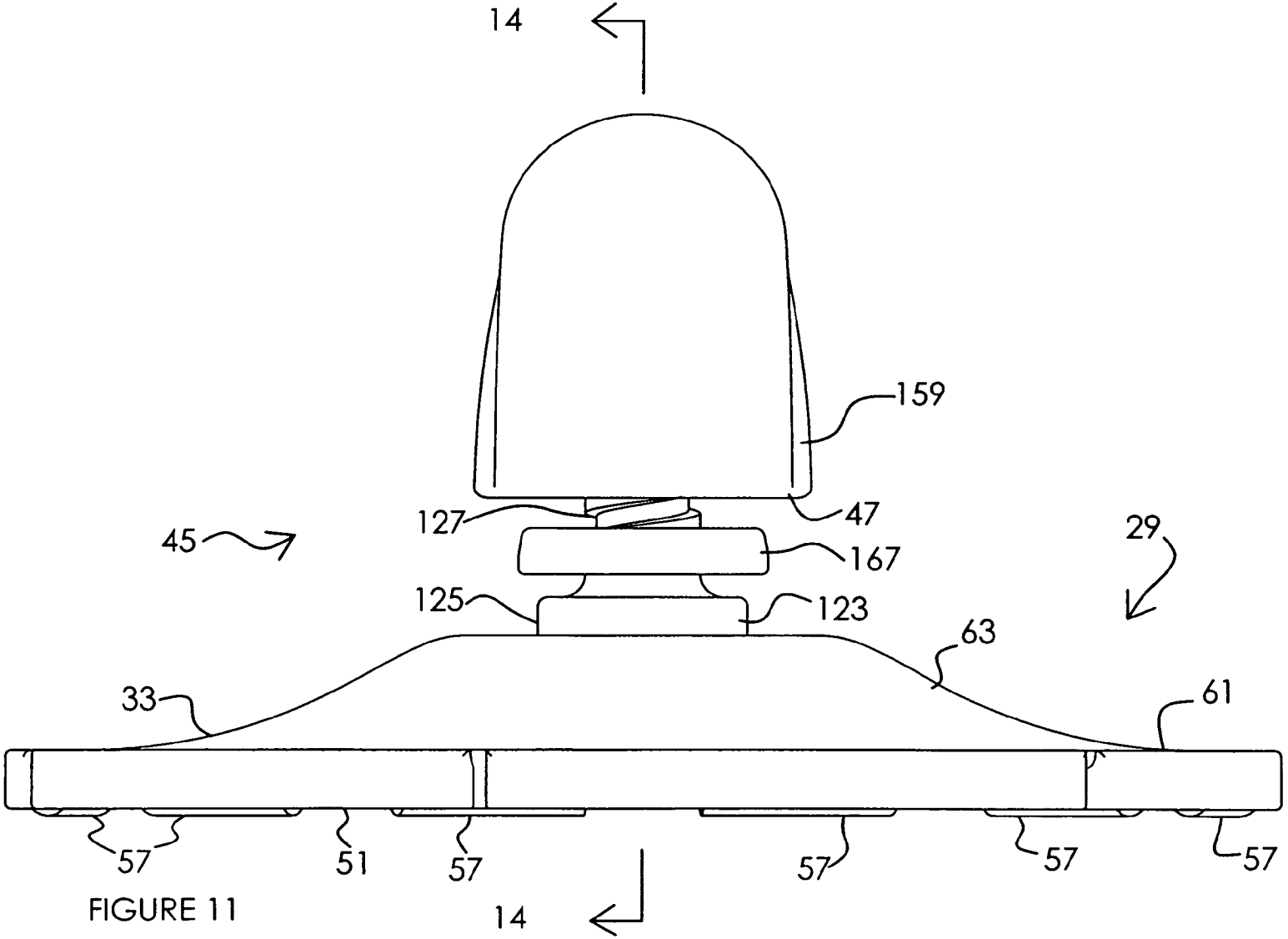
FIG. 11 is a side elevation view of the apparatus of this invention as configured in FIG. 3.
Figure 12:
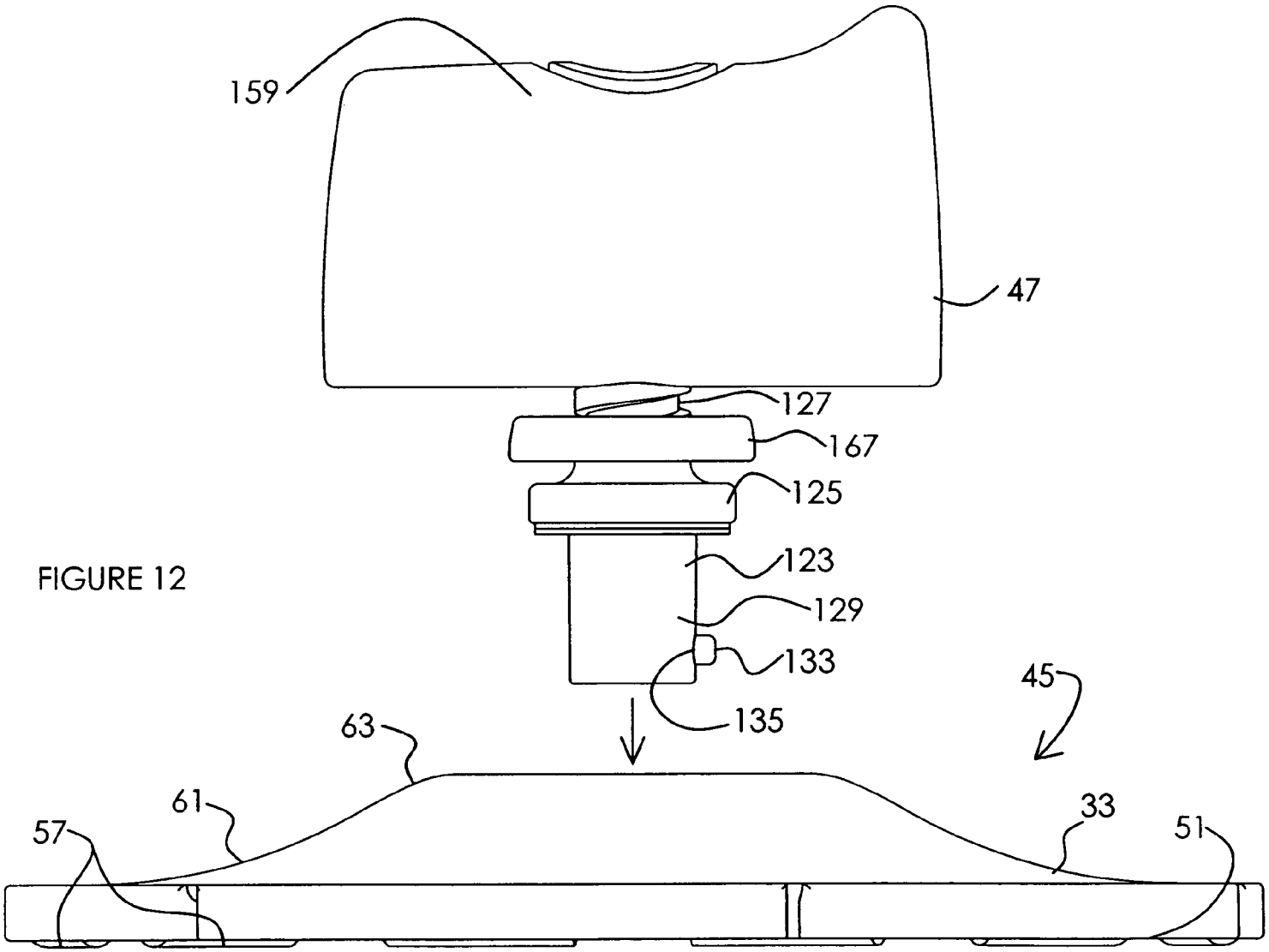
FIG. 12 is an exploded view of the apparatus as shown in FIG. 11.
Figure 13:
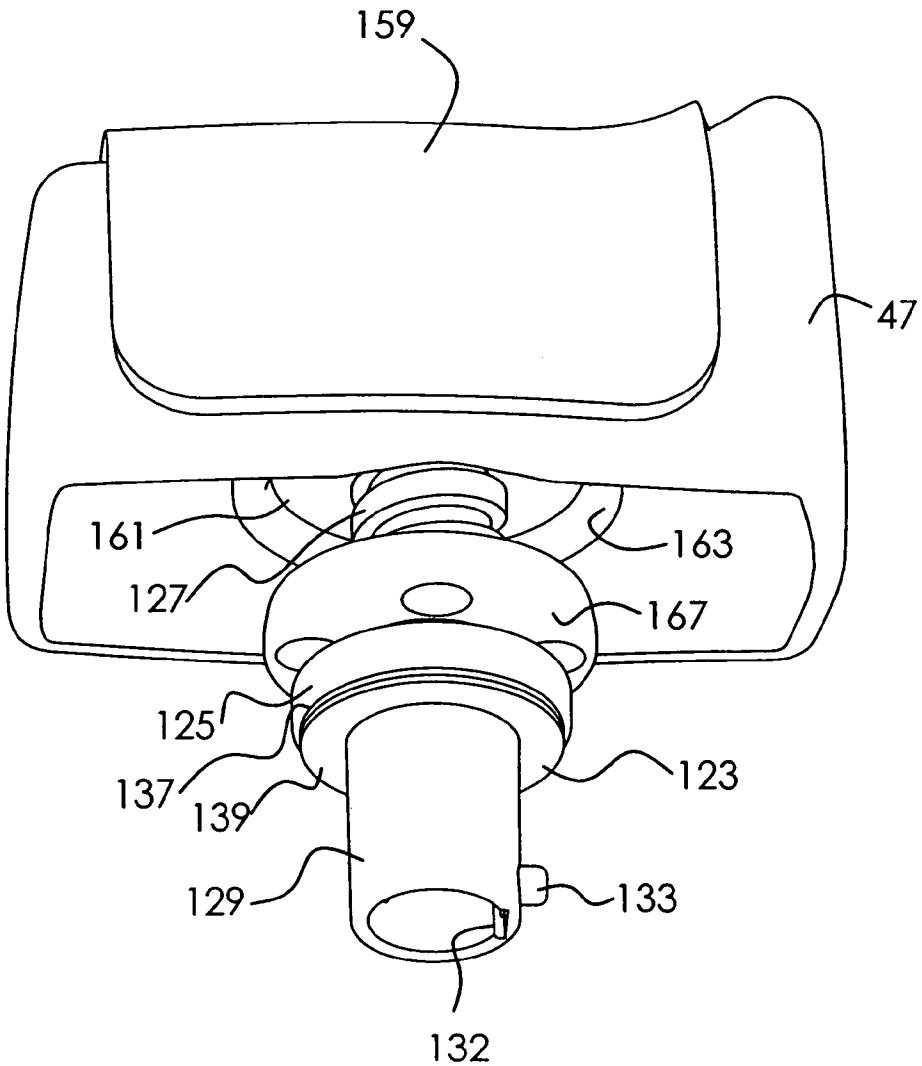
FIG. 13 is a perspective view of the handle portion of the apparatus as shown in FIG. 11.

For carpeted or other uneven surfaces where suction location of apparatus configuration 31 may not be practical, a retention mat 111 may be utilized as shown in FIGS. 9 and 10. These mats may be made of any firm and flat material suitable to hold the suction engagement of member 33 of the apparatus (for example, polypropylene plastic for rigid mats or polyethylene plastic for less rigid mats). The upper side of mat 111 may include a locating indicia 113 thereat (see FIG. 9). The bottom side is provided with appropriate slide resisting locators 115 such as prongs 117 and VELCRO style hook material 119 (in the case of mats suitable for carpeted surfaces; see FIG. 10) for firmly but releasable holding the apparatus in place during use.

Apparatus configuration 31 may be used for many known balance and core stability and strength enhancing type exercises involving engagement of the feet, knees, buttocks, hands, back, or abdomen with flat side 51 of platform 33. Such exercises may include static balance type exercise as well as dynamic exercise, and may incorporate either or both strength training and stretching type movement.

FIGS. 11 through 15 illustrate in greater detail push-up type exercise configuration 45 of apparatus 29. As noted above, in this configuration elevating and locating member 35 has been released from platform 33 by removal of plug/lock 105 from annular cavity 103 of shaft extension 75, thereby allowing deformation of annular protuberance 79 permitting withdrawal of extension 75 from opening 65.

Platform 33 is inverted (i.e., turned over) so that flat side 51 is adjacent the exercise surface, the plurality of gripping feet 57 resisting sliding of platform 33 on the surface.

Figure 14:
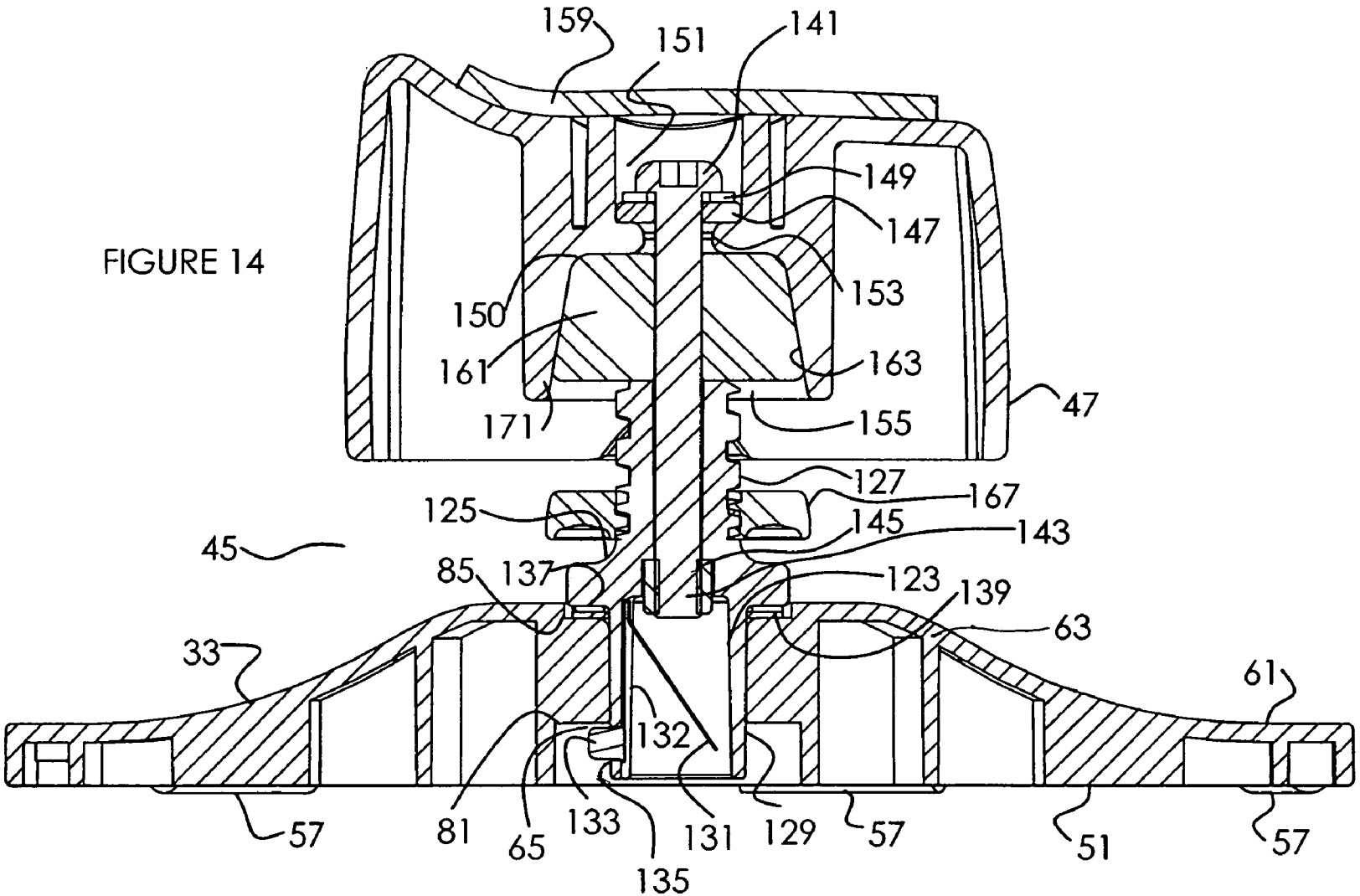
FIG. 14 is a sectional view taken through section lines 14-14 of FIG. 11.
Figure 15:
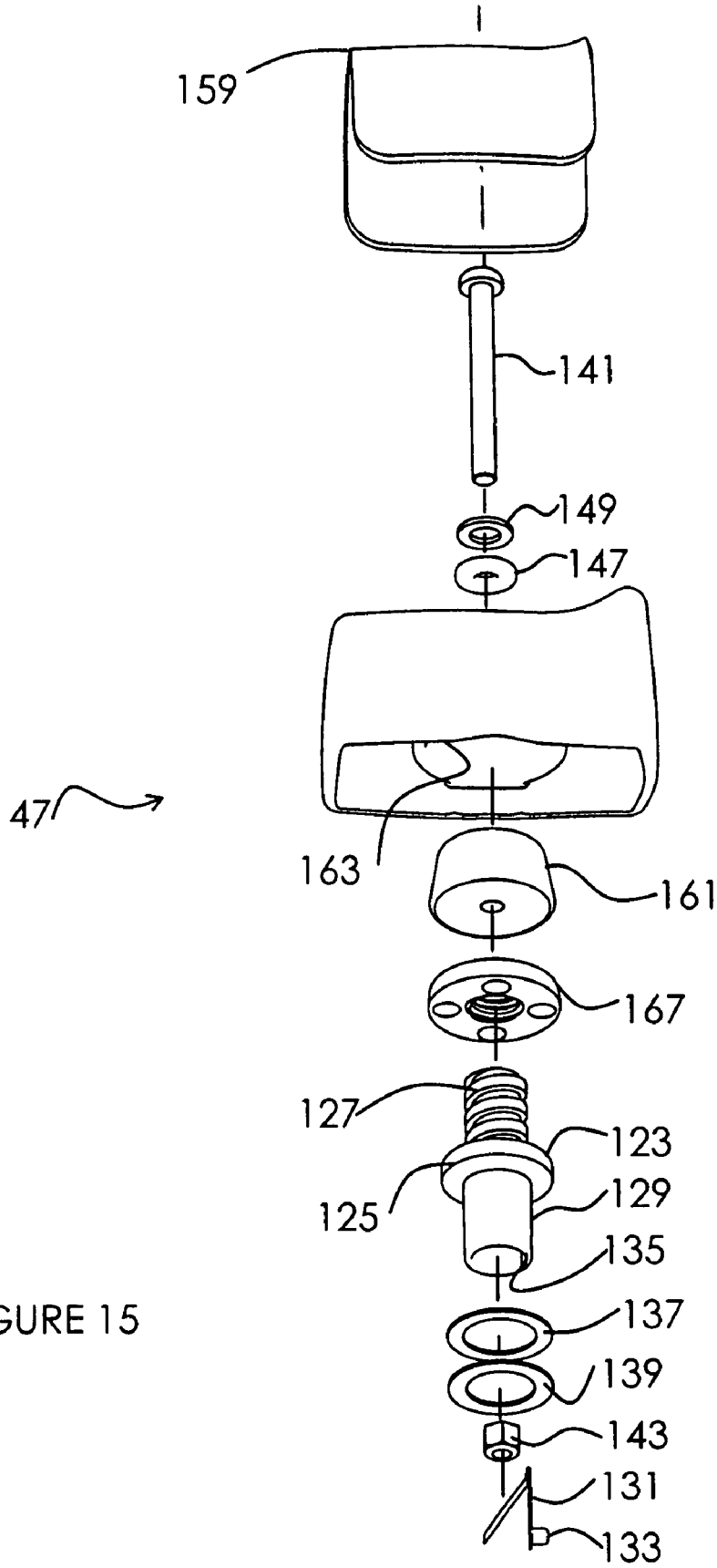
FIG. 15 is an exploded view of the handle portion of the apparatus as shown in FIG. 13.

Handle 47 is secured on stem 123 releasably receivable through opening 65 at raised center 63 of platform 33 (see FIG. 14). Stem 123 (made, for example of polypropylene plastic) includes retention body 125 (a larger diameter section) with threaded tubular shaft 127 extending from one side thereof and unthreaded tubular section 129 extending from the other side thereof. Stem 123 is releasably retained in opening 65 by spring clip 131 (a wire spring clip) residing in axial slot 132 in the inner wall of tubular section 129, and includes release button 133 protruding through opening 135 of tubular section 129. Fiber washer 137 and metal washer 139 are located over tubular section 129.

When tubular section 129 of stem 123 is fully inserted in opening 65, so that body 125 is adjacent to the crown of elevated center 63 of platform 33 and washers 137 and 139 are located in annular void 85 (see FIG. 14), button 133 of spring clip 131 releases through opening 135 below annular shoulder 81 of opening 65 thereby retaining stem 123 at platform 33. Stem 123 is thus maintained at platform 133 while allowing full 360° rotation of stem 123 within opening 65 during exercise. To remove stem 123 from platform 33, button 133 is depressed allowing withdrawal of stem 123 from opening 65.

Handle 47 is held on stem 123 by retention bolt 141 and nut 143. Nut 143 is located in annular cavity 145 in retention body 125 opening to both tubular passages through shaft 127 and section 129. Bolt 141 is received through compression washer 147, metal washer 149, mounting opening structure 150 of handle 47 and threaded shaft 127 of stem 123. The head of bolt 141 is lodged in cavity 151 of handle 47 having annular shoulder 153 at the bottom thereof and forming the enlarged uppermost portion of central mounting opening 155 through opening structure 150 (FIG. 14). Pad 159 (preferably a neoprene material) covers cavity 151 as well as the outer gripping surface of handle 47.

Bolt 141 also extends through rubber material bushing 161 having a truncated conical shape with a flat bottom that abuts threaded tubular shaft 127 of stem 123 when assembled. Flexible rubber bushing 161 is shaped to fit retention cavity 163 formed at opening 155 by mounting opening structure 150 in handle 47 (in a preferred embodiment, having its annular side wall angled outwardly at about 80° relative to the top surface of cavity 163). Flex limiter 167 (made, for example, from polypropylene plastic) is threadably engaged on threaded tubular shaft 127 of stem 123 and is manually adjustable along the length of the shaft. Limiter 167 is sized to accommodate the lowermost opening of cavity 163 when positioned thereat, and is utilized to limit the amount of tilting movement allowed to handle 47 under the influence of user weight applied at the handle when in use.

Figure 16:
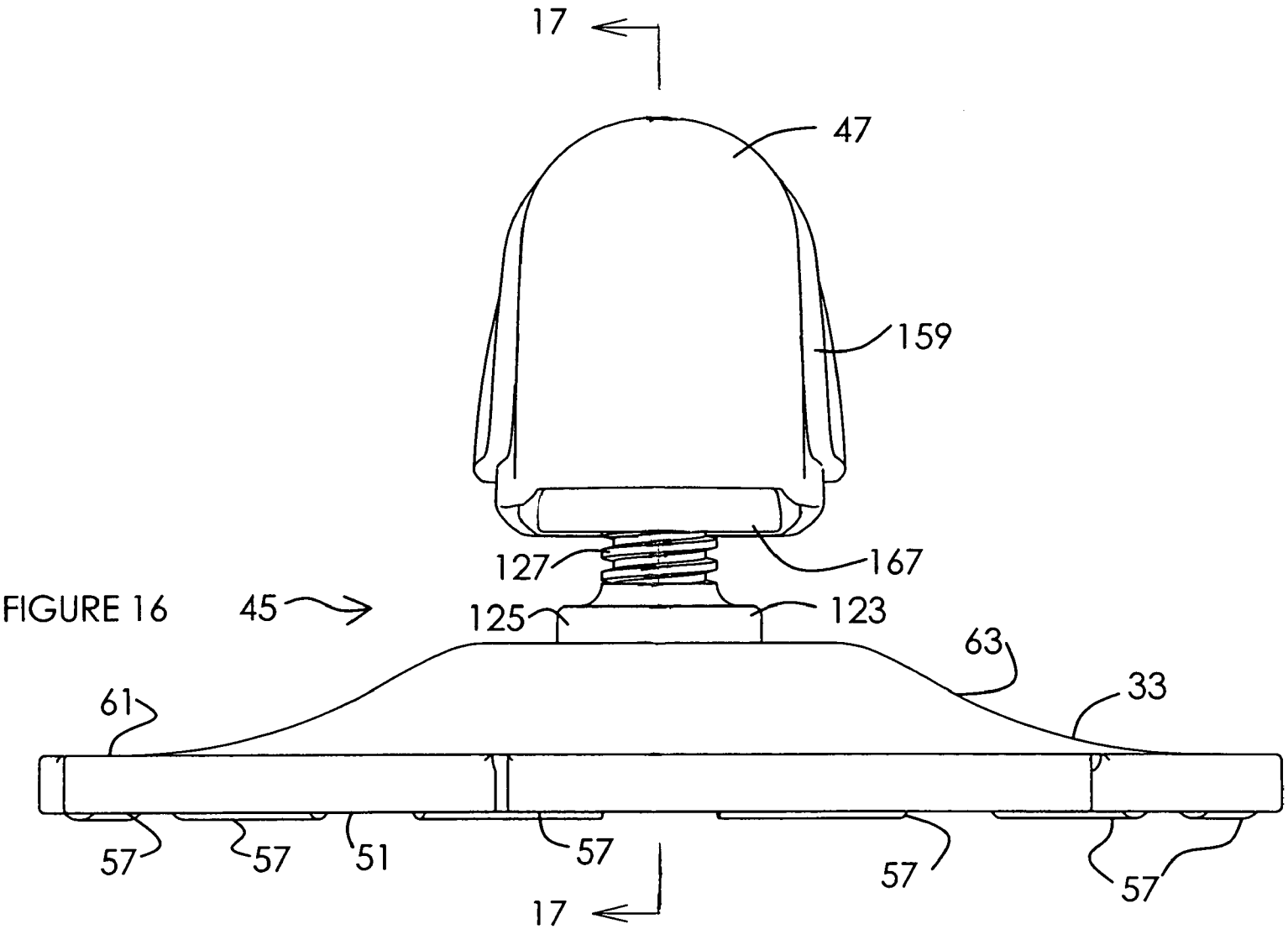
FIG. 16 is an end view of the apparatus as shown in FIG. 11 with a force applied from above at the opposite end.
Figure 17:
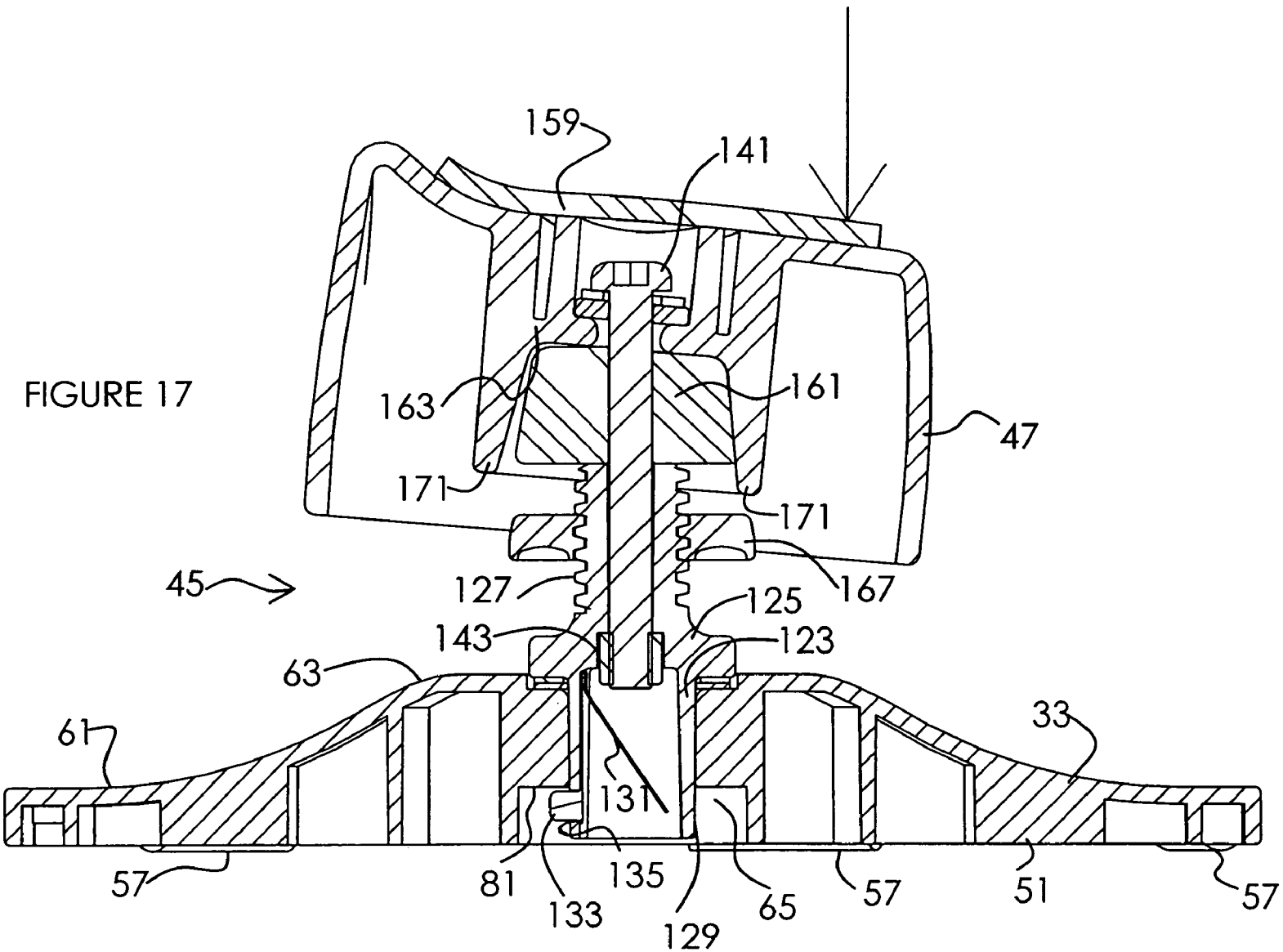
FIG. 17 is a sectional view taken through section lines 17-17 of FIG. 16.
Figure 18:
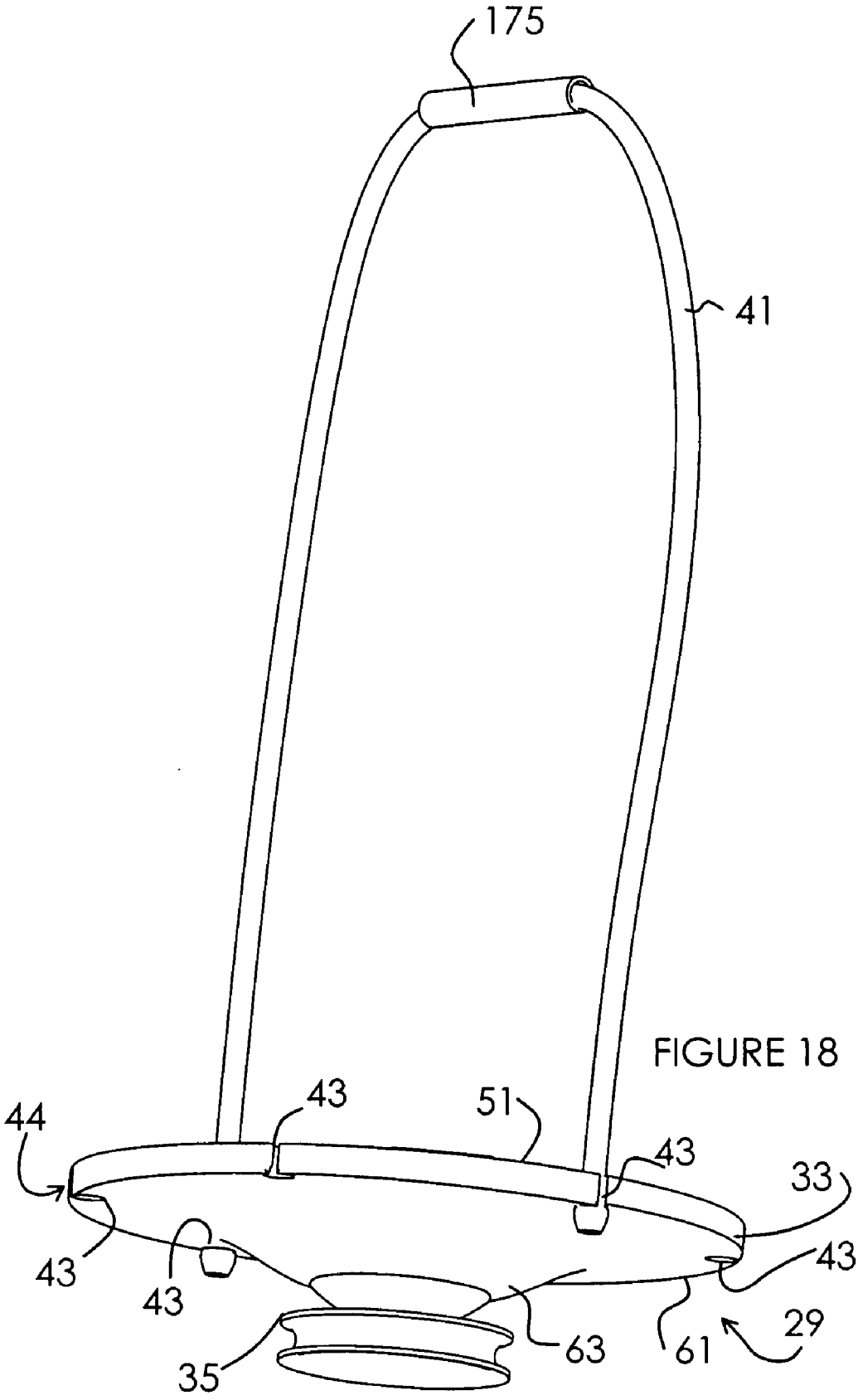
FIG. 18 is a perspective view of the apparatus of this invention as configured in FIG. 2.
Figure 19:
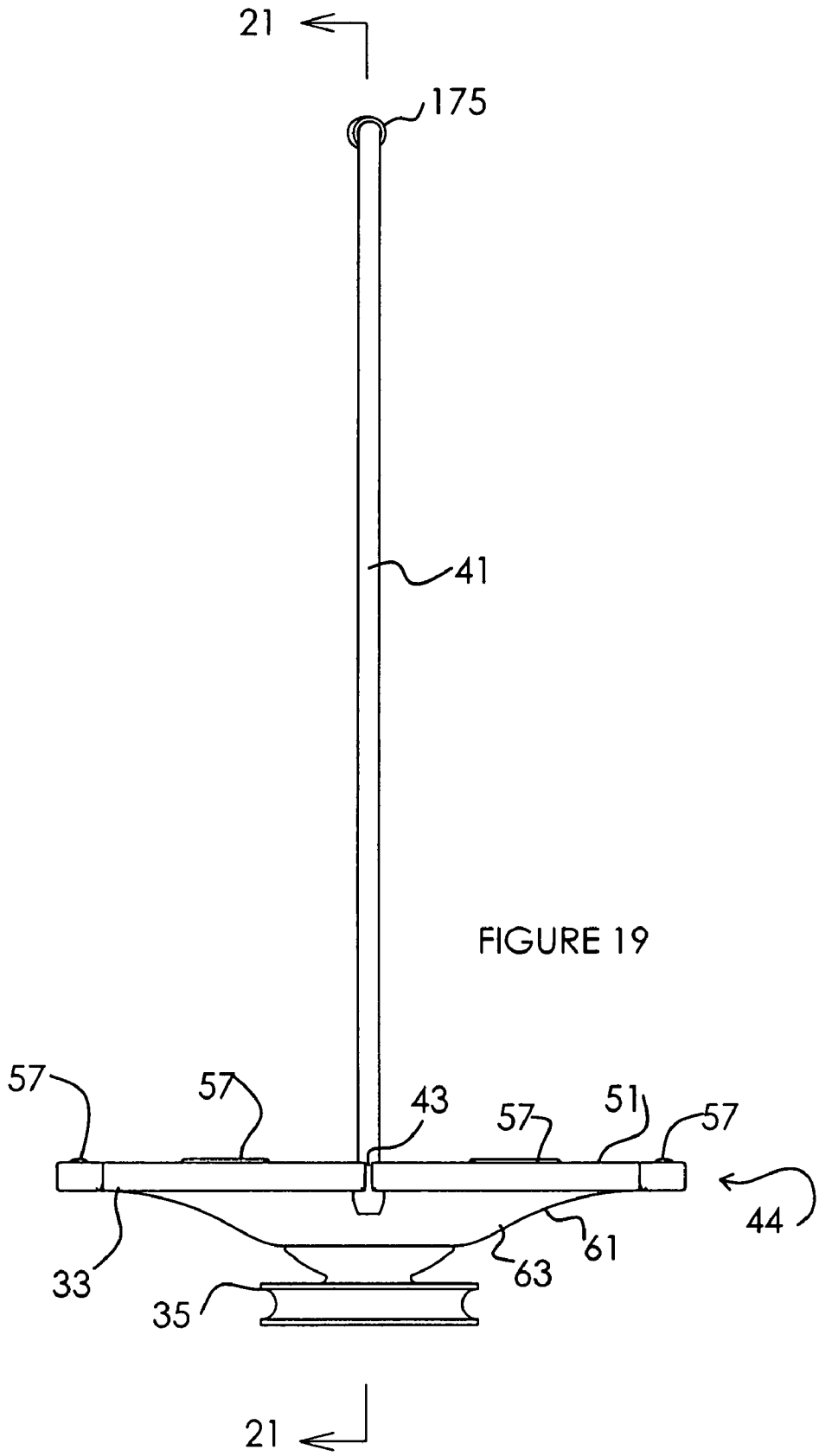
FIG. 19 is a side elevation view of the apparatus as shown in FIG. 18.
Figure 20:
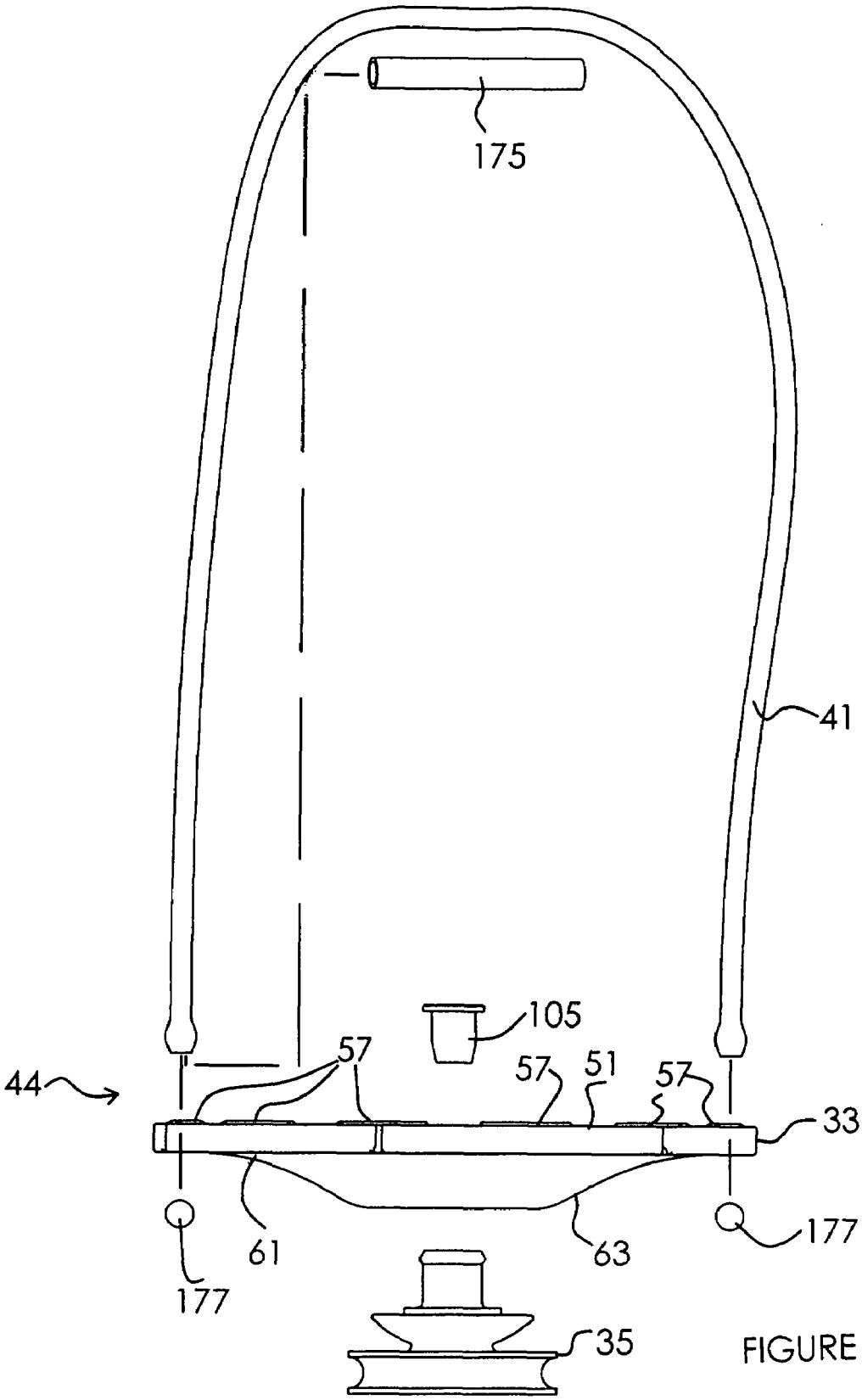
FIG. 20 is an exploded view of the apparatus as shown in FIG. 18.
Figure 21:
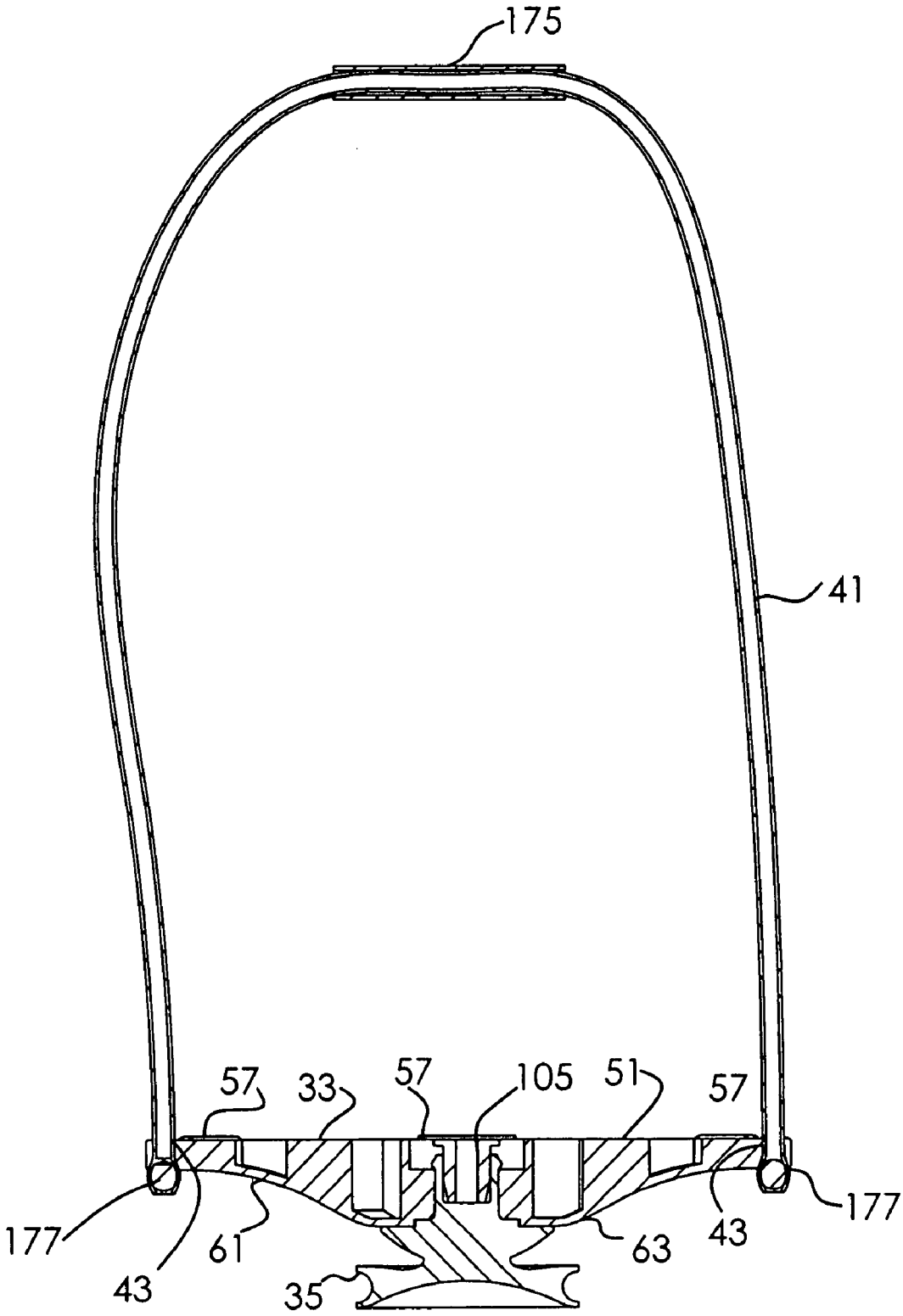
FIG. 21 is a sectional view taken through section lines 21-21 of FIG. 19.

When rotated to the very top of shaft 127 and abutting bushing 161 and cavity 163, almost no tilting movement is allowed (though handle rotation is uninhibited). When rotated to a lower position along the shaft, varying amounts of tilting movement of a universal scope (i.e., handle tilt response) are allowed during exercise as the variable directional downward pressure applied by a user changes, such pressure causing a responsive deformation of bushing 161 in cavity 163. Tilting movement is accommodated to the extent that lower annular wall 171 of cavity 163 does not contact limiter 167 (as illustrated by FIGS. 16 and 17). Greater spacing between limiter 167 and wall 171 thus allows a larger extent of handle tilt, while decreasing the spacing limits the extent of allowed handle tilt.

A large variety of exercises can be accommodated utilizing push-up type exercise configuration 45 of apparatus 29. These include, when utilized in a pair, standard push-ups, push-ups with hand positions at different rotations, and push-ups while rotating hand positions, all with selected handle tilt response to more fully train the involved arm muscles and further enhance core stability. Single handed arm exercise and balance exercises are also known and facilitated utilizing this configuration. Moreover, various other exercises such as squat thrusts (forward, side and reverse), leg lifts (forward, side and reverse) and the like may beneficially be performed utilizing this configuration.

Turning now to FIGS. 18 through 21, multi-workout configuration 44 of apparatus 29 is illustrated in greater detail. As noted, the additional attachment of a cord or cords 41 to platform through annular openings 43 provide for an expanded workout in combination with the balance platform configuration 31 (primarily, though use of the cords for enhancing workouts with push-up type exercise configuration 45 could also be conceived). Cords 41 have grip 175 slidably received thereover and are retained at openings 43 using ferrules 177 (wood ferrules for example) inserted into the ends of cord 41. Different cord lengths could be provided for different exercises, or the retainers could be configured to allow for cord length adjustment. While two connection locations of a single cord 41 to platform 33 and central slidable grip 175 are shown, it should be understood that a single connection location along a cord or cords 41, with a grip or grips mounted at the end or ends of each cord, could also be utilized.

The multi-workout configuration may be employed in conjunction with all exercises performed with balance platform configuration 31, and may be utilized to increase resistance to various exercise parameters in both of the other configurations, including use in conjunction with various types of squat and abdominal exercises. Moreover, cords 41 may be utilized for various lift and curl type exercises for both arms and legs.

The following are dimensions utilized in one preferred embodiment of the apparatus of this invention. Platform 33 has a diameter at flat side 51 of between about 9" and 14", a width between side 51 and side 61 from between about 0.5" at their outer circumference to about 1.5" at opening 65. Elevating and locating member may be about 2.6" tall providing overall platform elevation of about 1.4". Half oval hub 77 has a maximum diameter (at its interface with elevated center 63 of platform 33) of about 2.2", neck 73 has a diameter of about 1.5", shaft extension has a length of about 1.2" and a diameter of about 1.1", and grip 71 a diameter of about 3.85". Handle 47 has a grip surface length of about 5.4" and a width of nearly 4", overall height being about 3.3". Stem 123 has an overall length of about 3.3" thereby to maintain a gap of about 1.1" between the bottom of handle 47 and the adjacent top of platform 33. Cord 41 is preferably about ⅜" to ½" diameter cord.

In use, the apparatus of this invention helps avoid repeatedly putting the lower back in susceptible "loaded" positions and over-training strength in a solitary or isolated motion or pattern. Instead, use of the apparatus encourages tri-planar injury preventive endurance conditioning, proper motor control patterns, progressive training directed to task specific or sports related patterns of movement while avoiding over flexing (rounding) or hyper extending (arching) the lumbar spine, and use of sensation to mediate proprioceptive awareness (proprioception is the perception of position, posture and movement of the body in relation to the environment and is part of the body's feedback-feedforward system that routinely compensates for unpredictable postural perturbations). As is apparent, various exercises using the apparatus of this invention will require movement of the user's body through three dimensions at different velocities and while varying torques and forces, thus enhancing endurance, strength, and coordination.

The various configurations of the apparatus are designed to encourage complex multi-joint movements and focus on training sensation, awareness, and coordination, thereby to progressively increase motor control skill and postural efficiency, while also allowing for well thought out endurance and strength training. The lumbar spine is trained as an "intersection" to transmit load throughout the entire body. The greater the expected exertion or movement, the higher a threshold of bracing is needed to preserve the safe range of motion for the lumbar spine (i.e., avoiding full flexion). This is quite different from the isolative approach so often employed to train the core region or the repetitive and unnatural activities to accentuate muscle strength and size that are emphasized in the gym setting or with typical home fitness equipment. The apparatus of this invention can be used for injury prevention training, many different levels of rehabilitation, postpartum fitness, and as a dynamic baseline for sports performance training.

The balance platform configuration of the apparatus of this invention establishes a fixed center of axis that creates a pivot point for angular motion and a dynamic three-dimensional workout. Optimal postural control is strongly encouraged as the exerciser strives to maintain balance over the center of the board or boards, and it actually becomes quite difficult to utilize any bad postural habits. This configuration generates the need for positive adaptation throughout the entire body and reinforces natural patterns of movement and true core stability that cross over to everyday function.

In conjunction with the multi-workout configuration of this invention, cord or cords 41 encourage the pelvic and shoulders girdles to work both together and independently of one another, depending on the required movement. This configuration simultaneously allows for both an overload force and resistance to be developed, since cords 41 actually increase the ability to maintain balance. The self-calibration of elastic tension from cords 41 allow the user to distribute the load throughout the body in order to compensate for inhibited/weak areas (only to the degree that is required). The cords can be used as a balance aid to integrate the entire body or as a training tool to increase the intensity of the workout. This allows the user to train new and more efficient movement possibilities, progressively training the right muscle to work with the right amount of force at the right time.

The push-up type exercise configuration of the apparatus of this invention allows for all levels of training, from novices to advanced users, and provides a sophisticated means to train for dynamic postural trunk control. Exercises may be developed in conjunction with this configuration for increased motor control, training of the endurance of muscles capable of providing 360 degrees of support (anterior, lateral and posterior), as well as lumbar spine kinesthetic awareness. Handles 47 permit both rotation and varied levels of linear instability to improve proprioception of the shoulder girdle while performing a push-up or any of its variations. Flex limiter 167 affects the amount of linear instability allowed and provides the ability for a closed chain movement where the hand is locked into place, or an open chain movement that allows the hand to wobble in all directions. This allows the shoulder girdle to be trained in multiple levels of function required in natural movements.

As may be appreciated from the foregoing, an adaptable conditioning apparatus is provided for refined muscle training across multiple dimensions and addressing multiple training concerns including core stability and balance as well as muscle range of motion and strengthening. The apparatus is adaptable for application in a large variety of exercise types and for different parts of the body, while yet being quite compact and light weight.

Various ones of the configurations of the apparatus of this invention are particularly adapted to improve peripheral stability to create a dynamic base of support and action potential beneath the user's center of gravity, enhance neuromuscular adaptability and total body coordination to improve body movement self awareness and poise, make second nature motor control patterns and functional strength that will progressively increase the user's postural efficiency during active daily living and sporting activities, balance the myofascial connections that provide tension to support the user's skeletal frame as it's compressed by gravity, and create a reciprocal tensegrity structure capable of optimizing postural alignment and force distribution that will accommodate a wide range of movements (tensegrity is a total systems model that acknowledges the fact that the body structure is not simply soft tissue and multiple joints existing in near proximity, but rather a system of myofascial connections interdependent on each other for structure and function).

What is claimed is:

1. A surface locatable body conditioning apparatus comprising:

a relatively rigid platform having a substantially flat side and an opposite side, said opposite side including a truncated dome shape center portion; and a resilient locating member formed as a unitary structure of flexible rubber material and having one part centrally affixed at said opposite side of said platform and having a releasable grip spaced from said one part configured to firmly but readily releasably hold said apparatus at the surface selected for location of said apparatus without surface alteration.

2. The apparatus of claim 1 wherein said resilient locating member includes a flexible neck between said one part and said releasable grip, said neck having a cross section smaller than either said one part or said releasable grip.

3. The apparatus of claim 1 wherein said one part of said resilient member includes a mounting portion and wherein said platform includes a central opening extending from said opposite side, said mounting portion releasably engagable at said central opening.

4. The apparatus of claim 1 wherein said releasable grip of said resilient locating member is a suction grip.

5. The apparatus of claim 4 further comprising a carpet retention mat having slide resisting carpet engaging means at a bottom side thereof and a top side adapted for suction engagement.

6. A body conditioning and balance training apparatus comprising:

a relatively rigid disc shaped platform having a substantially flat side and an opposite side that is elevated toward its center, said elevated center having an opening thereat; and a one piece resilient elevating and locating member having one part centrally affixable through said opening at said elevated center of said opposite side of said platform, a support spaced from said one part having a surface gripping portion configured to engage, hold and stabilize said apparatus at a selected workout location, and a neck located between said one part and said support, said surface gripping portion of said support including a suction cup structure.

7. The apparatus of claim 6 further comprising at least one resiliently stretchable cord securable at circumferential structure defined in said platform.

8. The apparatus of claim 7 wherein said circumferential structure includes a plurality of openings providing plural releasable engagement sites for said cord.

9. The apparatus of claim 8 wherein said one part of said elevating and locating member includes a half oval hub, a smaller diameter neck portion located intermediate said suction cup portion and said half oval hub.

10. The apparatus of claim 6 wherein said one part of said elevating and locating member includes a flexible tubular shaft extension and wherein said opening at said elevated center of said opposite side of said platform extends through said platform to said flat side, said apparatus further comprising a plug/lock insertable through said opening at said flat side of said platform into said tubular shaft extension.

11. A surface locatable adaptable body conditioning apparatus comprising:

a first relatively rigid disc shaped platform having a substantially flat side and an opposite side;

a first resilient locating member formed as a unitary structure of flexible rubber material and having one part centrally affixed at said opposite side of said platform and having a releasable grip spaced from said one part configured to firmly but readily releasably hold said apparatus at the surface selected for location of said apparatus without surface alteration;

a second relatively rigid platform; and a second resilient locating member centrally affixed at said second platform and having a releasable grip configured to firmily but readily releaseably hold said second resilient locating member at the selected surface without surface altercation.

12. The apparatus of claim 11 wherein at least one of said releasable grips of said first and second resilient locating members includes a suction gripping structure.

13. The apparatus of claim 11 wherein said flat side of said first platform has a maximum dimension between about 9" and 14".

14. The Apparatus of claim 11 further comprising at least one additional attachment selectively receivable at least at one of said platforms for a different type of exercise.

15. The apparatus of claim 14 wherein at least one of said first and second platforms includes circumferential openings and wherein said one additional attachment includes at least one resiliently stretchable cord selectively receivable through a selected one or ones of said circumferential openings.

16. The apparatus of claim 14 wherein said opposite side of said first platform is elevated toward its center, wherein said resilient locating members are for adapting said platform for use in balance enhancing exercises, and wherein said flat side of said first platform includes circumferential openings therein, said apparatus further comprising a plurality of gripping feet positioned in selected ones of said circumferential openings for resisting sliding of said first platform when said first resilient locating member is released from said platform and said platform is inverted thus allowing use of said first platform in an alternative exercise with said flat side adjacent the selected surface.

17. The apparatus of claim 16 wherein said elevated center of said first platform has an opening thereat for releasable receipt therethrough of said one part of said first resilient locating member, and wherein said one additional attachment includes a handle having a stem receivable in said opening at said elevated center of said first platform when said first resilient locating member is released from said platform.

18. The apparatus of claim 17 wherein said handle and said stem are configured to allow a selected amount of handle tilt response during use, and wherein said stem is configured to be receivable in said opening at said elevated center so that said handle is releasably and rotatably secured at said platform.

* * * * *